United States Patent [19]

Roblin

[11] 4,335,793

[45] Jun. 22, 1982

[54] PROCESS AND APPARATUS FOR BORING SITES

[75] Inventor: Pierre G. Roblin, Paris, France

[73] Assignee: Soudure et Mecanique Appliquees du val Notre-Dame, Val d'Oise, France

[21] Appl. No.: 177,763

[22] PCT Filed: Mar. 29, 1979

[86] PCT No.: PCT/FR79/00028

§ 371 Date: Nov. 30, 1979

§ 102(e) Date: Nov. 30, 1979

[87] PCT Pub. No.: WO79/00859

PCT Pub. Date: Nov. 1, 1979

[30] Foreign Application Priority Data

Mar. 30, 1978 [FR] France ..... 78 09298

[51] Int. Cl.[3] ..... E21B 10/44; E21B 17/22; E21B 21/00

[52] U.S. Cl. ..... 175/65; 175/249; 175/323

[58] Field of Search ..... 175/65, 58, 244, 249, 175/254, 323, 394, 310; 299/87

[56] References Cited

U.S. PATENT DOCUMENTS

| | | | |
|---|---|---|---|
| 1,740,449 | 12/1929 | Blakeslee . | |
| 1,997,313 | 4/1935 | Satre . | |
| 2,197,580 | 4/1940 | Jensen et al. . | |
| 2,537,605 | 1/1951 | Sewell | 175/249 X |
| 2,587,231 | 2/1952 | Schierding | 175/249 X |
| 2,865,608 | 12/1958 | McKenna | 175/245 X |
| 2,873,950 | 2/1959 | Kandle . | |

FOREIGN PATENT DOCUMENTS

| | | |
|---|---|---|
| 1256598 | 6/1966 | Fed. Rep. of Germany . |
| 1308682 | 10/1962 | France . |
| 2165181 | 8/1973 | France . |
| 2186038 | 1/1974 | France . |
| 301706 | 12/1954 | Switzerland . |

*Primary Examiner*—Stephen J. Novosad

*Attorney, Agent, or Firm*—Sandler & Greenblum

[57] ABSTRACT

The invention relates to a process and apparatus for the boring of sites. The tool comprises a container 6 reinforced by a beam 10 assuring the coupling with the drive system 2 and ending in an opening door 28. The container defines an interior volume for the collection of the debris. The lateral knives 50 associated with the openings provided with a gate 53 assures the formation of the excavation. The container 6 is equipped to the exterior with a helix 60 making possible to control the displacement of liquids in the space provided between the container 6 and the bore. The invention relates particularly to boring tools used in the presence of liquids.

33 Claims, 10 Drawing Figures x
x'
2
D
3
6a
6
Se
1
7
5
Sc
-8-
42
St
4
F
9
Db
G
R 20
19
17
Y
H
16
21
21
11
13
23
23
22
27
24
22
-8-
d3
25
26
60
37
40
34
d1
38
VII
52
53
55
33
d2
39
56
VII
29
32
31
30
28
42

PROCESS AND APPARATUS FOR BORING SITES

BACKGROUND AND SUMMARY OF THE INVENTION

The present invention relates to a process of boring sites in the presence of liquids; particularly for the formation of foundations; of mineral prospectings, etc., the boring being done by a rotating tool as well as by a gripping tool.

Boring in the presence of liquids includes all boring conducted in aqueous sites and/or in dry sites but with the introduction of fluids such as bentonite muds, chemical compounds, grout, etc. The process according to the invention comprises, in its general aspect, separating, in the course of the boring operation, the excavated material and the surrounding liquids by storing the excavated material in an interior volume provided on the interior of the tool and by permitting a controlled circulation of the liquids outside of the interior volume in a reserve volume for the excavated material.

Thus, during the boring operation itself, one assures the circulation of the liquids towards the lower portion of the excavation created and more particularly in such a fashion that the face being excavated is continually and conveniently lubricated.

Likewise, during the descent and raising of the boring tool before and after the boring operation itself, one promotes according to the invention respectively the raising of the liquids towards the top of the excavation or the descent of the liquids towards the end of the excavation thus avoiding the piston effect caused by the displacement of the tool.

According to a preferred aspect of the invention, the circulation of the liquids occurs in a volume provided between the tool and the lateral wall of the excavation.

Furthermore, one preferably assures a forced circulation of the liquids in the reserve volume which is reserved for them.

In the particular instance where the boring is created by virtue of a turning tool, at least during the boring operation itself, one creates the circulation of the liquids towards the bottom by guiding them along a substantially descending helicoidal trajectory.

Furthermore, during the descent of the tool before the boring operation itself, one causes, by virtue of the displacement of the tool, a circulation of the liquids towards the top, in the opposite direction of the displacement of the tool and preferably along a substantially ascending helicoidal trajectory.

Conversely, during the raising of the tool after the boring operation itself, the circulation of the liquids towards the bottom is caused, by virtue of displacement of the tool, in the opposite direction of the latter along a substantially descending helicoidal trajectory.

The invention relates equally to a boring tool adapted in a fashion so as to make possible to perform the above process and comprising at least a container defining a closed interior volume, this container being provided with retainer means permitting the introduction of the excavated materials in the interior volume while forbidding their exit, emptying means for evacuation of the interior volume of the container which is controlled by a voluntary control system, at least one cutting element which, at least in the boring position, projects to the exterior of the container in a fashion so as to result in an excavation having transverse dimensions greater then the tranverse dimensions of the container, and circulating means for circulating, during the boring operation, the liquids found in the excavation, outside of the volume of the container reserved for the excavated material.

Advantageously, the means assuring the circulation of the liquids are provided with a reserve volume between the walls of the excavation and the lateral wall adjacent to the container of the tool which defines the volume reserved for the excavated material, this volume reserved for the liquids being, according to one preferred embodiment, arranged in a fashion so as to permit a circulation of the liquid such that the liquid assures a constant lubrication of the working elements of the tool without them having damaging effects during the displacement of the tool particularly during the lowering and raising, the controlled circulation of the liquid completely avoiding any piston affect during the excavation.

Applicant has been able to determine that to obtain the desired effects, the ratio between the transverse section of the interior volume reserved for the excavated material and the transverse section of the exterior volume reserved for the circulation of the fluids has to be between 2 and 3 in current boring conditions.

According to an advantageous embodiment of the invention, the lateral external wall of the tool can be equipped with protrusions, in the form of blades for example, extending towards the exterior and substantially perpendicularly to said wall. Naturally, the width of these projections will be less than or at most equal to the width of the cutting element.

Furthermore the blades will preferably have a slope, that is they form an angle other than 90 degrees with the generator line surfaces of the tool container. According to a preferred but not limiting embodiment, the blades, continuous or discontinuous, will surround the container along its entire periphery while providing between them, in the direction towards the top of the tool, guiding means in the form of guiding passages for the liquid going around the container.

In the case where the container of the tool is of a generally cylindrical shape, the blades will be helices or portions of helices wound around the container.

If the tool is rotated during the boring operation itself, the pitches of the helices are oriented opposite to the direction of rotation of the tool such that the liquids, during boring, are guided towards the bottom of the excavation, so as to lubricate the working portions of the tool. One thus achieves a forced guidance of the liquids.

According to another aspect of the invention, the cutting elements comprise at least two knives attached laterally of the exterior of the container of the tool and adjacent to its working end, an opening provided in the container being associated with each of the knives and being equipped with a pivotable door or gate which disengages the opening when a pressure exerts itself on it from the exterior towards the interior of the container and which, on the contrary, blocks it when the pressure exerts itself in the opposite direction. Furthermore, the working end of the tool is constituted by a rocking door allowing for the evacuation of the interior volume of the container, this door being locked in closed position by a latch carried by the container, this latch being controlled by a mechanical system making possible its opening and being drawn back into locked position by an elastic system.

BRIEF DESCRIPTION OF THE DRAWINGS

Other characteristics and advantages of the present invention will appear from the following description of one embodiment of the invention, given by way of non-limiting example with reference to the annexed drawings, in which.

DESCRIPTION OF PREFERRED EMBODIMENTS

Figures 1, 2, 3, 4:
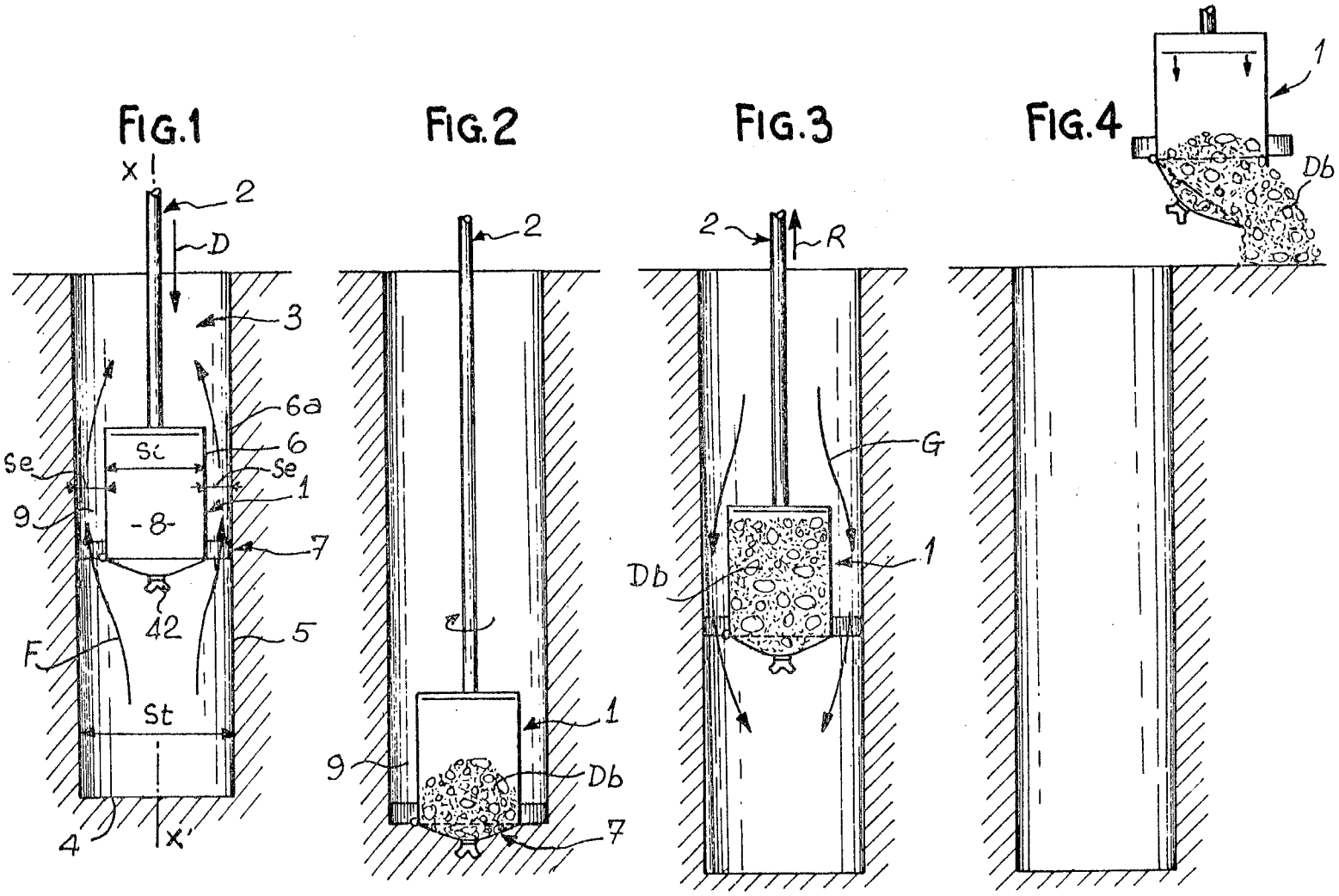
FIGS. 1, 2, 3 and 4 are operating diagrams showing a boring tool according to the invention in different phases of its use.

In the description which follows, one will assume for simplicity, that the boring device is of the type which is rotated around its axis, even though the invention, as has already been indicated may be adapted for different types of tools.

In FIGS. 1 to 4, a tool itself 1 has been generally shown with a shaft 2 for rotationally driving which is fixed between the tool and on the other hand to a classical drive system not shown. The excavation is shown at 3 with its front face 4 and its lateral wall 5.

The tool 1 comprises a body 6 which, in the example shown is cylindrical but which may be of any other appropriate shape, this body extending towards the bottom by working portions of the tool schematically shown at 7 and defining furthermore an internal closed volume 8 in which the boring excavated material is stored. As will be seen from the drawings, the working portions 7 project towards the exterior with respect to the walls of the container in a fashion such that the lateral wall 5 of the bore is spaced from the lateral wall of the container, a reverse volume 9 being thus provided between these walls to allow for the circulation of the liquids found in the excavation.

According to the invention, the spacing between the container 6 and the lateral wall 5 of the excavation is such that it must allow for a free circulation of the liquids around the tool to avoid the inconveniences resulting from too close a proximity of the container wall 6 and the wall 5 of the excavation which results in throttling of the surrounding liquid which results in two harmful effects:

an irregular erosion of the interior wall of the excavation and thus an uncontrolled oversizing thereof;

a mechanical decomposition action of the ambient liquids caused by the throttling whose effects (by virtue of the rotation of the tool) are comparable to sedimentation or centrifugation.

Reserving a relatively substantial volume 9 between the tool and the wall of the excavation eliminates these inconveniences. Furthermore, it remedies the piston effect which results when one lowers or raises in the excavation a tool having a space 9 which is too small. In effect, with the tool of the invention, it is seen that when one lowers the tool 1 in the excavation in the direction of the arrow D of FIG. 1, the liquid which is under the tool has the possibility of escaping towards the top of the tool in the direction of the arrows F of FIG. 1, the space 9 being sufficiently large to permit such a displacement at a convenient speed.

Furthermore during the raising of the tool in the direction of the arrow R of FIG. 3, the liquid which is found above the tool can easily redescend, in the direction of the arrow G toward the bottom of the excavation.

One thus understands that this ease of circulation of the liquids, on the one hand, will facilitate the displacement of the tool by resulting in the savings of time and energy and, on the other hand, will avoid a deterioration of the excavation which would inevitably be produced during the descent as well as during the raising of the tool if the volume 9 were too small to permit the free circulation of the liquids.

The applicants have established that the cross section Se (measured in a transverse plane to the direction X—X' of displacement of the tool) of the space 9 reserved between the excavation wall and the container of the tool (it is shown in the illustrated example by an annular space) is a function of speed of circulation of the liquids in the said space 9 and obeys the relationship $$Se = f(vf) \times St$$

where vf is the flow speed of the ambient liquid and St the total cross section of the bore created by the tool.

Furthermore, the applicants have discovered that to obtain an optimal result, the sections Si of the interior volume reserved for the excavated material and Se must be such that:

$$2 < Si/Se < 3,$$

The cross section of the space 9 can vary naturally as a function of the nature of the terrain, the physical characteristics (viscosity, density, etc . . . ) of the liquid employed, and of the characteristics of the tool.

Furthermore, the space 9 is advantageously provided, according to the invention such that during the excavation itself (shown in FIG. 2), the surrounding liquids are forced to be displaced in the direction of the working parts of the tool while thus constituting between themselves and the face of the excavation a sort of film lubricating of the cutting elements of the tool. An advantageous embodiment of these forced displacement means of the liquids will be described below.

Finally, as is seen in FIG. 4, when the volume 8 of the tool reserved for the excavated material Db is filled, one empties the latter after having extracted the tool from the excavation, by opening the end of the tool.

It will be noted that according to a possible alternative embodiment, the volume 9, instead of being defined by the lateral wall 6 of the container and the wall 5 of the excavation, may be provided between the wall 6 of the container and a second wall (shown as 6*a* and in dashed lines in FIG. 1) integral with the wall 6 but spaced therefrom, the space thus provided between the walls 6 and 6*a* being naturally open at its upper and lower ends to permit the circulation of the liquids.

One will now describe in detail an exemplary embodiment of a tool according to the invention with reference to FIGS. 5 to 10.

The tool according to the invention comprises a container 6 having a generally cylindrical body whose upper portion is reinforced by a beam 10 having a substantially rectangular cross section, the beam being made integral with the container, for example, by welding. The beam is in itself integral with a drive head 11 of the tool in which is adapted to engage the rotational drive shaft 2 of the device. Tubular sleeves 13-14-15 (three in the example shown arranged at 120 degrees from each other) are attached to the container 6 and to the beam 10, these sleeves extending parallel to the axis Y—Y' of the container 6. In each of the sleeves 13-14-15 is mounted in a sliding fashion a cylindrical shaft respectively 16-17-18. Each of the shafts have their upper end 19 fixed (for example by a pin) to a common ring 20 extending transversely to the axis Y—Y'. Between the ring 20 and each sleeve 13-14-15, the shafts 16-17-18 carry a spring 21 whose role will be explained further on.

The portions 22 of the shafts which come out of the sleeves 13-14-15 towards the interior of volume 8 provided on the interior of the container for the excavated materials are of reduced diameter which defines a shoulder 23. The constricted portions 22 of the shafts traverse in a slidable fashion a moveable plate 24 provided on the interior of the volume 8 under the beam 10. The sliding shafts 17 and 18 are provided with a disk 25 integral with the corresponding shaft, the said disks 25 sustaining the moveable plate 24 and forcing it against the fixed beam 10 by virtue of the action of springs 21.

At least one of the shafts (the shaft 16 in the example shown) extends beyond the constricted portion 22 into a portion having a larger diameter 26 which defines with the portion 22 a shoulder 27 which is likewise supported against the moveable plate 24 by virtue of the action of spring 21. It will be noted that by virtue of the presence of the constricted portions 22, a relative displacement or clearance is permitted between the moveable plate on the one hand and the shafts 16-17-18 on the other hand, this clearance corresponding to the height of the constricted portions 22. To summarize, as soon as the shoulders 23-25 or 27 are in contact with removeable plate 24, the displacement of the shafts causes that of the moveable plate in the vertical direction.

The moveable plate 24 acts as a pressure element and serves to push the excavated material to the exterior of the volume 8 during the emptying of the tool shown in FIG. 4. This operation is linked to the unlatching of a front door generally designated 28 which blocks the lower end of the volume 8. This door 28 which will be described in detail below is journalled around a hinge joint 29 carried by the lower end of the container 6.

This door 28 which substantially has the shape of a pan comprises a median beam 30 of substantially V shape reinforcing a metallic panel 31. At its end opposite to the hinge 29, the beam carries a catch 32 permitting the latching of the port in the closed position shown in FIGS. 5, 6 and 7 by virtue of a latch 33 comprising an L clasp rocking around an axis 34 maintained in the bearings 35 fixed on the outer end of the container 6.

The control of the latch is performed by the shaft 16. The portion 26 of this shaft is guided in a sliding fashion on a bearing 36 fixed to the interior of the container 6 and beyond this bearing the shaft 16 ends in an extension 37 traversing in a sliding fashion a slit 39 provided in the horizontal branch of the L latch 33. At the end of the extension 37 is fixed a traverse 39 which is supported under the horizontal branch of the latch so as to draw the latter into its latching position shown in FIG. 5 by virtue of the action of spring 21. It will be noted that the portion 37 of the shaft arranged above the latch comprises a control element such as welded plate 40 which in the latched position of the latch (shown in FIG. 5) comes to abutt against the bearing 36, this plate being thus spaced from the branch 38 of the latch by a distance "d1". Furthermore, still within this locked position shown particularly in FIG. 6, a distance "d2" separates the pusher element traverse 39 ending the shaft 16 from the rounded apex 41 of the clasp 32 integral with the door, "d2" being greater than "d1". Furthermore, it will be noted that the distance "d3" separating the moveable plate 24 from the shoulders 23 of the shafts 16-17-18 is greater than "d2".

This arrangement is particularly desirable for assuring an evacuation of the excavated material of the tool in the best possible conditions. In effect, the opening of the door 28 is realized by bringing the crown 20 towards the rest of the tool, against the action of the springs 21. In the course of this relative displacement, the shafts 16-17-18 acting as coupling means integral with the crown 20 displace themselves downwardly. The plate 40 first contacts the latch 33 which it causes to rock thus liberating the clasp 32. The shaft 16 continues to descend, the traverse 39 is brought against the clasp 41 which it pushes towards the bottom thus aiding the opening of the door. Finally, the shoulders 23 of the shafts ultimately are supported against the moveable plate 24 which they likewise push downwardly. The pressure of the plate 24 on the excavated materials assist in their ejection outside of the tool as is seen in FIG. 4.

As is seen in FIGS. 1 to 6, a conventional centering element can be mounted under the door 28. Furthermore, the said door has openings 43 making possible the entrance of the excavated materials into the space 8 of the tool which is reserved for them.

The attack edge 44 of the openings 43 is bevelled or can be equipped with interchangeable cutting or scraping blades or elements so as to scrape the bottom of the excavation. The opposite edge 45 of the openings is equipped, from the interior side of the door with a fixed hinged pin 46 on which is mounted the joint of a gate 47 maintained in place by a pin 48, the said gate being free to rock in the direction of the double arrow A of FIG. 5 and itself blocking the opening 43 under the effect of its own weight and of the weight of the excavated material found in the tool. In summary, it is clear that when the tool turns in the direction of the arrow H of FIG. 5, the pressure of the excavated material scraped by the edge 44 of the opening will be sufficient to raise the gate which will let the excavated material enter.

Furthermore, on the end of the container 6 adjacent to the door 28 are mounted two cutting elements which in the example shown are removeable knives 50 whose attack portion is U-shaped turned towards the container 6, while the heel in the shape of a fork is lodged and immobilized in a support 51 fixed on the container 6. As is seen particularly in FIG. 7, the knives extend substantially tangentially to the container 6 and their attack edge **50*a*** is oriented in the direction of rotation of the tool so as to form the lateral wall of the excavation.

Furthermore, to the right of each of the forks 50, the container 6 is perforated with an opening 52 permitting the entrance of the excavated material to the interior of the space 8.

A a retainer means comprising rocking gate or door 53, journalled around a vertical axis 54 carried by fixed bearings 55 provided on the interior of the container 6, makes it possible to block (position shown in solid line) the passage provided by the openings 52 to avoid escape of the excavated material to the exterior. In summary, this gate can open itself (position shown in dashed line) to let the excavated material penetrate into the tool. A shoulder 56 limits the opening of the gate towards the interior. It will be noted that in the closed position, the gate abuts against the internal face of the corresponding knife cutting element (see FIG. 7).

Figure 7:
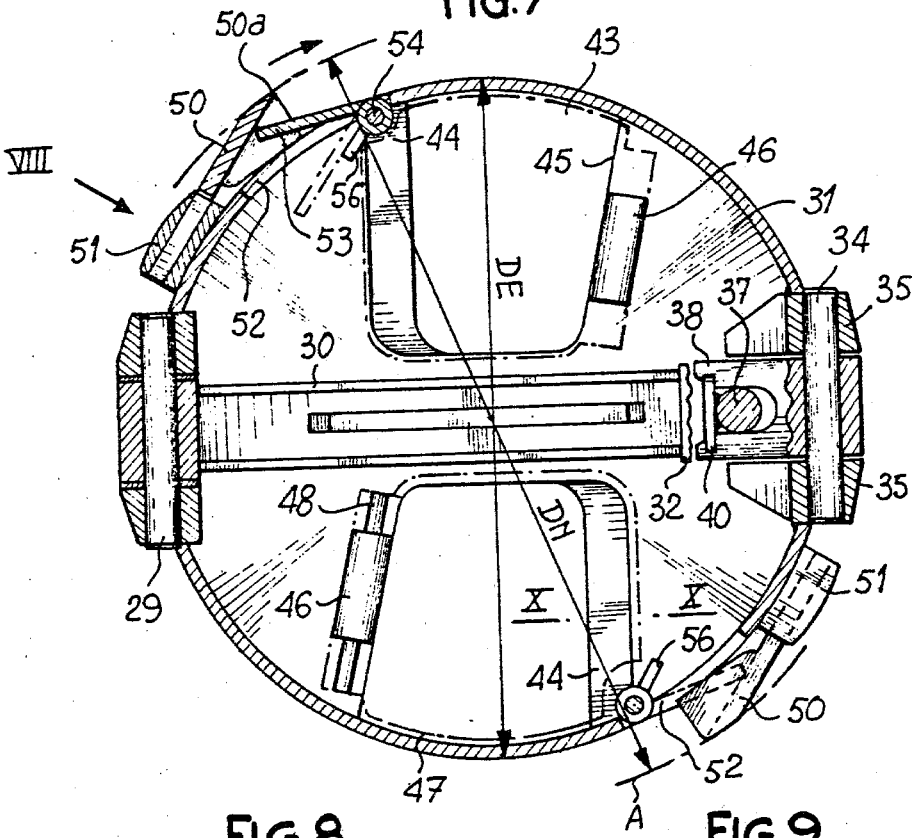
FIG. 7 is a cross sectional view along line VII—VII of FIG. 6.

As seen in FIG. 7, the knives project in a relatively substantial fashion with respect to the container 6 and thus form an excavation having a cross section of diameter DN greater than the diameter DE of the cross section of the container.

The volume provided between the container 6 and the resulting surface, in the course of operation of the tool by the knives 50 (this surface having a cross section of diameter DN) is the reserve volume designated as 9 in FIGS. 1 to 3 and reserved for the circulation of the liquids.

Figure 5:
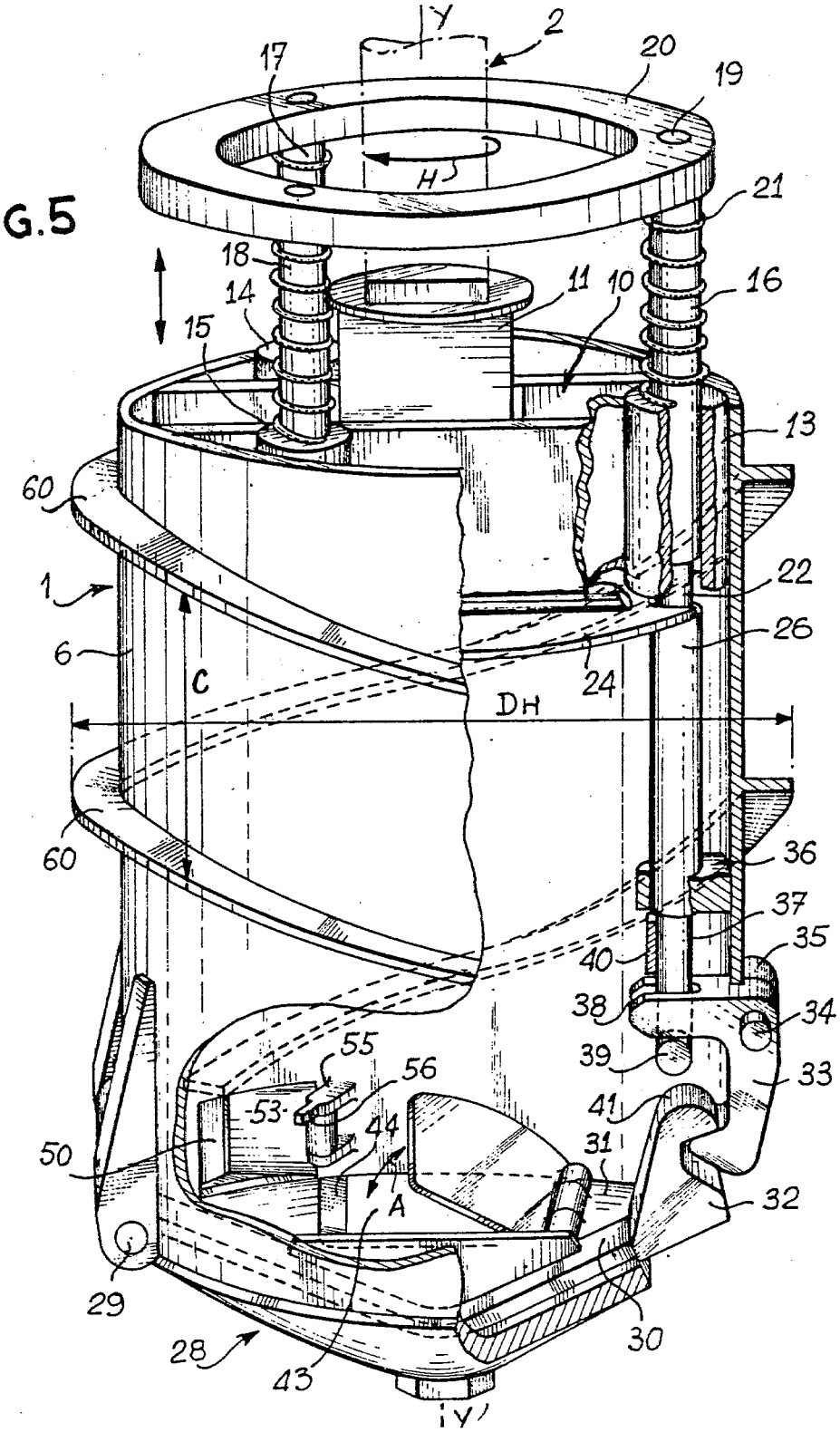
FIG. 5 is a view on a larger scale in perspective with partial exposure of a boring tool according to the invention.
Figure 6:
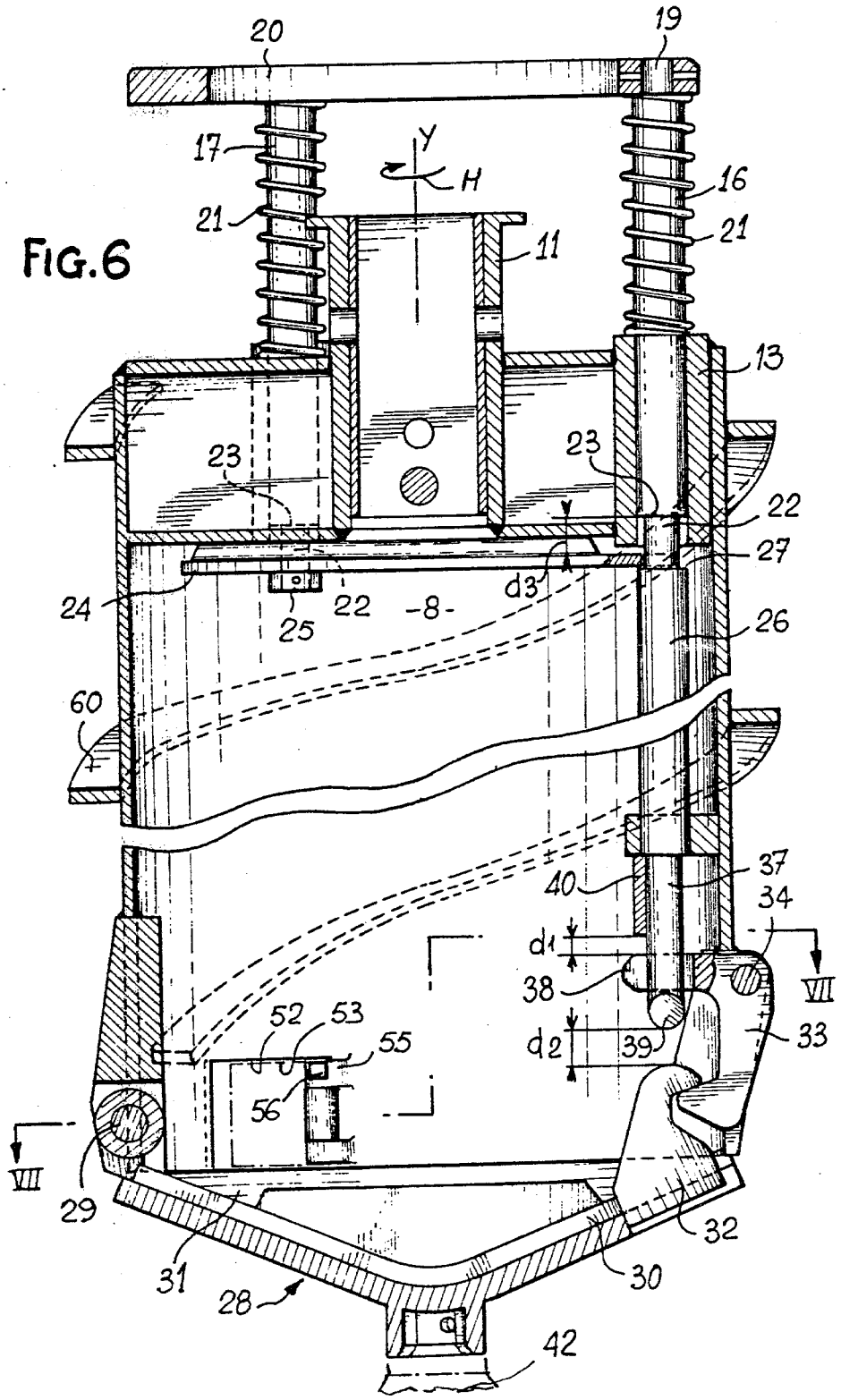
FIG. 6 is an elevational cross sectional view of FIG. 5.

Finally, as is seen in FIGS. 5 and 6, in the reserve volume 9, to the exterior of the container the blades 60 extend which constitute the means of adapting this volume to assure a control of the circulation of the liquids. In the example shown, the blades 60 are in the form of at least one continuous helix winding around the container 6 and welded thereto; the said helix extending approximately perpendicularly to container 6 and in the example shown, has a slope of approximately 45 degrees.

It will be understood however that while the choice of the continuous helix is preferred for economic and practical reasons, one can provide different apparatus without going beyond the scope of the invention and with the aim of adapting the tool to specific work conditions, the essential being that the means adapting the space reserved for the circulation of the liquids carries out a certain number of objectives which include among others:

(a) to assure, during the boring operation itself a forced circulation of the liquids in the direction of the end of the excavation to lubricate the working parts of the tool; in the preferred case the tool is equipped with a helix as in the example shown, one attains this objective by giving to the pitch of the helix a direction opposite to that of the direction of rotation H of the helix (see FIG. 5). In effect, in such a case, the liquids, in the course of the rotation of the tool are driven downwardly by the helix.

(b) To increase the trajectory of the liquids around the tool, which in the example shown is made possible by the fact that the liquids are required to move around the tool in the direction of a helicoidal trajectory in the spaces in the shape of canal C (see FIG. 5) defined by the container, two successive streams 60 of the helices and the wall of the excavation itself.

(c) To permit a free circulation of the liquids during the descent and the raising of the tool such that they do not oppose the displacement of the latter; this is obtained by the fact that the circulation zones of the liquid between the threads of the helices are wide, the diameter DE of the container being substantially smaller than the diameter DN of the excavation which results. Thus, for example, in the case of a tool forming an excavation of approximately 850 millimeter diameter (DN) the diameter (DE) of the container will be approximately 710 millimeters, which signifies that the space 9 provided for the circulation of the liquids between the tool and the excavation will have a width of approximately 70 millimeters.

Naturally, it must be avoided that the helices 60 touch the walls of the excavation and the diameter DH of the helices will thus be less than the diameter DN of the excavation.

Furthermore, the slope of the helices will be sufficiently substantial, on the order of 45 degrees and as a result, one will be able to provide depending upon the case one or several helices (in the example shown, there are two).

Figure 8:
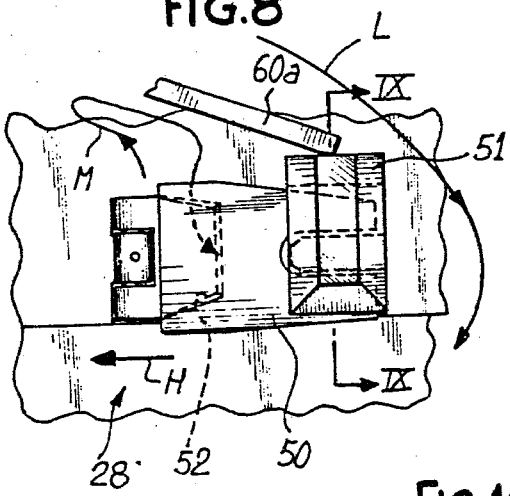
FIG. 8 is a partial view along arrow VIII of FIG. 7.
Figure 9:
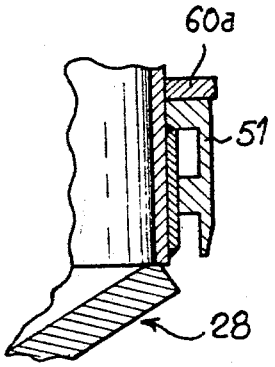
FIG. 9 is a cross sectional view along line IX—IX of FIG. 8.
Figure 10:
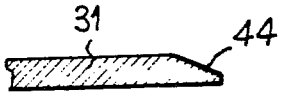
FIG. 10 is a cross sectional view along line X—X of FIG. 7.

Finally, it will be noted, with reference to FIG. 8, a specific arrangement of the tool facilitating the separation of the liquids and excavated material.

As is seen in FIG. 8, each of the two helices 60 ends at 60*a*, adjacent to the working end of the tool, the ends of the helices being welded respectively on one of the supports 51 of one of the lateral knife cutting elements 50.

The end 60*a* of the helices thus plays a deflector role acting as a stopping means preventing the excavated material from rising in the space 9 reserved for the circulation of the liquids. In effect, the tool turning in the direction of the arrow H, one sees that the excavated material which will have a tendency not to penetrate into the interior of the tool via the opening 52 will be brought back automatically downwardly, that is to say towards the opening 52, by the effect of the helix 60*a*. The trajectory which the excavated material may have has been schematically shown as M.

Naturally it will be understood that a comparable result will be obtainable if one provides, instead of the helix 60*a* a deflector constituted by a plate fixed to the container in the same arrangement as a helix.

Furthermore, the trajectory of the liquids guided by the helix at the level of the working elements of the tool has been shown as L. One notes that the liquids are free to circulate behind the support 51 and to descend under the door 28. The circulating liquids in the direction of the arrow L thus assure a lubrication of the opposite knife 50 as well as for the attack edges 44 of the openings 43 of the door 28.

I claim:

1. A tool for boring an excavation comprising:

(a) a container adapted to receive material excavated from said excavation in an enclosed interior volume arranged within said container, said container comprising retainer means allowing said material to enter therein while not allowing said material to leave said container during normal operation; said retainer means comprising at least one opening, each of said at least one openings being blocked by a blocking element adapted to block said excavated material from leaving said container while allowing said excavated material to enter said container;

(b) emptying means for emptying the interior of said container;

(c) at least one cutting element adapted to project during excavation beyond the exterior of said container so as to excavate an excavation having transverse dimensions greater than the transverse dimensions of said container; and (d) circulating means for circulating liquid during the boring operation from the top to the bottom of said tool outside of said container, said circulating means comprising a reserve volume provided between the exterior lateral wall of said container and the wall of said excavation or of a surface parallel thereto.

2. The tool as defined by claim 1 wherein the ratio of the transverse cross-section of said interior volume to the transverse cross-section of said reserve volume is between 2–3:1.

3. The tool as defined by claim 1 wherein said reserve volume includes guiding means for guiding the displacement of liquid through said reserve volume, said guiding means being arranged on the lateral wall of said tool.

4. The tool as defined by claim 3 wherein said guiding means comprise blades extending to the exterior of said lateral wall, each of said blades having a width less than the extent to which said cutting element projects from the lateral wall of said container.

5. The tool as defined by claim 4 wherein each of said blades extends over the entire circumference of said lateral wall.

6. The tool as defined by claim 5 wherein said blades form passages between them which surround said lateral wall of said tool, said passages extending upwardly on said tool.

7. The tool as defined by claim 6 wherein said container is substantially cylindrical and said blades extend helically around the exterior of said lateral wall.

8. The tool as defined by claim 7 further comprising means for rotating said tool in a direction opposite to the pitch of said helical blades.

9. The tool as defined by claim 1 wherein each of said at least one cutting elements comprises a knife affixed to the exterior of said container adjacent the lower end of said container, and wherein each of said knives faces one of said openings, each of said openings being associated with said retainer means comprising a pivotable gate, said pivotable gate being adapted to yield to pressure from outside said container to permit said excavated material to enter said container, said gate being further adapted to block said opening in response to pressure from within said container to prevent excavated material from leaving said container.

10. The tool as defined by claim 1 wherein one end of said container comprises a rocking door journalled onto said container whereby the internal volume of said container may be emptied by opening said rocking door, and a latch adapted to secure said rocking door in a closed position.

11. The tool as defined by claim 10 further comprising mechanical means for opening said rocking door.

12. The tool as defined by claim 11 further comprising elastic means adapted to maintain said rocking door in a closed position.

13. The tool as defined by claim 12 wherein said rocking door comprises at least one opening provided with a scraping blade and further comprising a pivotable gate allowing said excavated material to enter said container while preventing said excavated material from leaving said container.

14. The tool as defined by claim 1 further comprising stopping means for stopping excavated material from entering said reserve volume.

15. The tool as defined by claim 14 wherein said stopping means comprise a deflector attached to said lateral wall above each of said cutting elements and positioned so as to direct excavated material into said openings.

16. The tool as defined by claim 15 wherein each of said deflectors comprises at least a portion of a helical element surrounding said tool.

17. The tool as defined by claim 16 wherein each of said deflectors is adapted in the vicinity of each of said cutting elements so as to allow circulating liquid to pass between said reserve volume and the end of said excavation.

18. An excavating tool comprising:

(a) a drive system;

(b) a container connected to said drive system, said container comprising an enclosed interior volume;

(c) means for introducing excavated material into said enclosed interior volume;

(d) emptying means for emptying the interior volume of said container, said emptying means comprising a rocking door mounted on said container, said rocking door being held in the closed position by a latch mounted adjacent to said rocking door; said latch being adapted to be operated by a control element;

(e) a pusher element adapted to abut against said door when said latch is opened and to exert a pressure on said door in a direction so as to assist in the opening of said door; and (f) a pressure element adapted so as to be able to exert pressure on said excavated material within said interior volume in the direction of said rocking door.

19. The excavating tool as defined by claim 18 further comprising coupling means for coupling said control element, said pusher element and said pressure element whereby movement of said control element to release said latch results in the movement of said pusher element to assist the opening of said door after the release of said latch and prior to movement of said pressure element.

20. The excavating tool as defined by claim 19 wherein said coupling means comprises a sliding shaft mounted within said interior volume, said sliding shaft adapted to be activated when said tool has been removed from the excavation.

21. The excavating tool as defined by claim 20 wherein said sliding shaft comprises said control and pusher elements, both of which are integral with said shaft.

22. The excavating tool as defined by claim 21 wherein said pressure element comprises a moveable plate, said moveable plate being mounted between two shoulders on said shaft.

23. The excavating tool as defined by claim 22 wherein said sliding shaft is spring biased to maintain said control element in a position keeping said rocking door closed.

24. The excavating tool as defined by claim 22 wherein when said sliding shaft is in its biased position, the distance between said control element and said latch is less than the distance between said pressure element and said rocking door, which distance is less than the distance separating each of said shoulders.

25. The excavating tool as defined by claim 24 wherein said latch is in the form of an angle and is adapted to be pivoted so as to release a catch mounted on said door.

26. A process for excavating material in the presence of a liquid to form an excavation with a boring tool, said boring tool comprising a container whose cross-section is less than the cross-section of said excavation, a drive shaft extending to the exterior of said excavation, and at least one cutting element projecting out of the lateral surface of said tool, and wherein at least a portion of said cutting element is positioned at the base of said tool, whereby a reserve volume is provided between the exterior lateral surface of said container and the wall of said excavation, said tool further comprising guiding means for guiding the displacement of said liquid through said reserve volume, said guiding means being arranged on the lateral wall of said container, said process comprising the steps of:

(a) inserting said tool within said excavation; and (b) rotating said shaft to rotate said tool whereby the rotational movement of said tool causes said guiding means to circulate said liquid towards the closed end of said excavation to lubricate the boring action of said tool.

27. The process as defined by claim 26 comprising rotating said tool by rotationally driving said drive shaft from the exterior of said excavation.

28. The process as defined by claim 26 wherein said guiding means comprises at least one blade positioned on the exterior surface of said tool, said at least one blade forming inclined passages along said tool and said process comprises circulating said liquid downwardly along said passages by means of said blades.

29. The process as defined by claim 28 wherein said at least one blade extends helically around the exterior surface of said tool and wherein said process comprises guiding said liquid in a forced circulation along said passages in said reserve volume.

30. The process as defined by claim 26 further comprising continuously separating said material being excavated from said liquid.

31. The process as defined by claim 30 wherein said container comprises an interior volume and a pivotable gate covering an opening in said container, said pivotable gate being journalled onto said container and whereby said process comprises passing said excavated material into said internal volume through said pivotable gate.

32. The process as defined by claim 31 wherein said at least one blade ends adjacent to one of said at least one cutting elements and said process comprises deflecting said excavated material off of said at least one blade into said interior volume through said opening.

33. The process as defined by claim 26 wherein the ratio of the transverse cross-section of said interior volume to the transverse cross-section of said reserve volume is between 2:1 and 3:1.

* * * * *

UNITED STATES PATENT AND TRADEMARK OFFICE

CERTIFICATE OF CORRECTION

PATENT NO. : 4,335,793

DATED : June 22, 1982

INVENTOR(S) : Pierre Georges ROBLIN

It is certified that error appears in the above-identified patent and that said Letters Patent is hereby corrected as shown below:

Column 2, line 19, "affect" should be --effect--.

Column 2, line 37, delete "surfaces".

Column 3, line 34, after "driving" insert --the tool--.

Column 3, line 35, delete "on the other hand to".

Column 3, line 48, "reverse" should be --reserve--.

Column 3, line 60, after "thereof" insert --and--.

Column 6, line 1, "39" should be --38--.

Column 6, line 18, "moveable" should be --movable--.

Column 6, line 33, "moveable" should be --movable--.

Column 6, line 59, "removeable" should be --removable--.

Column 6, line 10, "abutt" should be --abut--.

Column 7, line 3, delete "a".

Column 9, line 37, after "adjacent" insert --to--.

Column 10, line 52, "moveable" should be --movable--.

Column 10, line 53, "moveable" should be --movable--.

Signed and Sealed this

Sixteenth Day of November 1982

[SEAL]

*Attest:*

GERALD J MOSSINGHOFF

*Attesting Officer*

*Commissioner of Patents and Trademarks*